United States Patent [19]

Harris, III

[11] 4,051,338

[45] Sept. 27, 1977

[54] LOAD RESPONSIVE SWITCH ACTUATOR

[75] Inventor: Newton T. Harris, III, Canoga Park, Calif.

[73] Assignee: Greer Hydraulics, Inc., Los Angeles, Calif.

[21] Appl. No.: 580,310

[22] Filed: May 23, 1975

[51] Int. Cl.[2] ..... H01H 3/14

[52] U.S. Cl. ..... 200/85 R; 200/82 C; 200/153 T

[58] Field of Search ..... 200/85 R, 61.4, 153 T, 200/82 C, 82 D, 153 W; 340/272

[56] References Cited

U.S. PATENT DOCUMENTS

| | | | |
|---|---|---|---|
| 1,918,450 | 7/1933 | Broeske | 200/153 W |
| 2,462,041 | 2/1949 | Hohler | 200/85 |
| 2,821,593 | 1/1958 | Sogorka, Jr. et al. | 200/286 |
| 3,718,785 | 2/1973 | Kudritzki | 200/153 T |

*Primary Examiner*—David Smith, Jr.
*Attorney, Agent, or Firm*—Gardner and Anten

[57] ABSTRACT

A load responsive switch actuator mechanism comprises a body of deformable material (e.g., an elastomeric material) which deforms under either compressive or tensile forces to actuate a switch. In one preferred embodiment the deformable material is in the form of a solid, generally cylindrical configuration which, when compressed, will expand in diameter to actuate a load responsive switch. In a second preferred embodiment the deformable material is in the form of a generally cylindrical tube which, when subjected to a tensile load, will decrease in diameter and actuate a load responsive switch.

4 Claims, 6 Drawing Figures

FIG. 1.
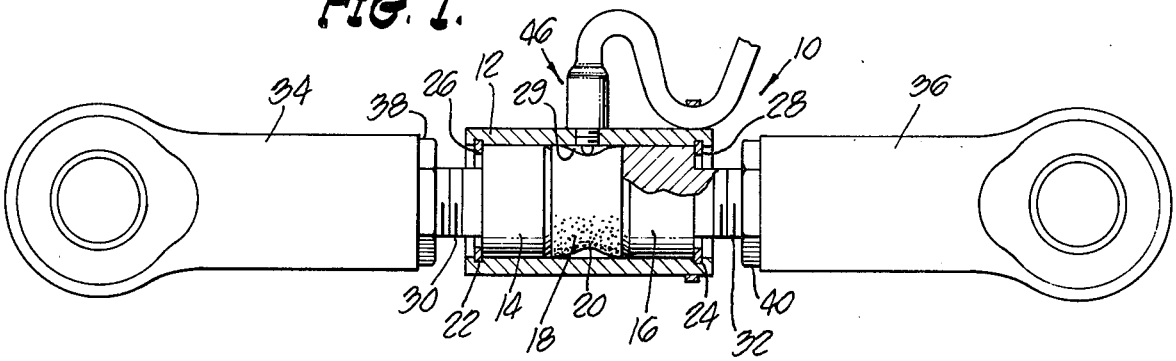
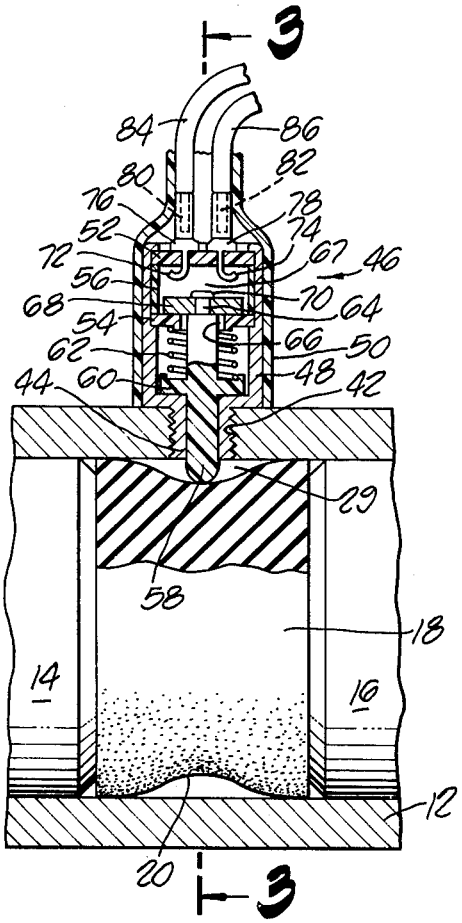
FIG. 2.
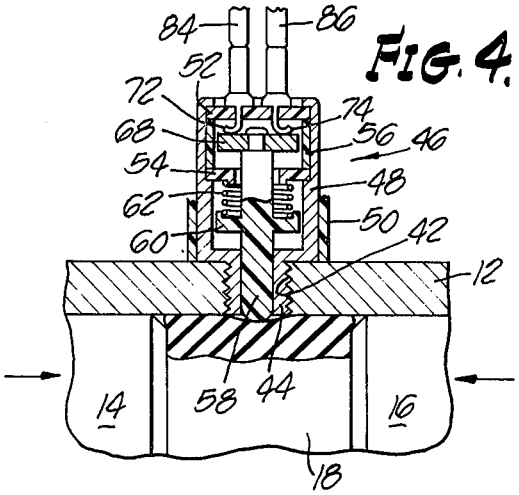
FIG. 4.
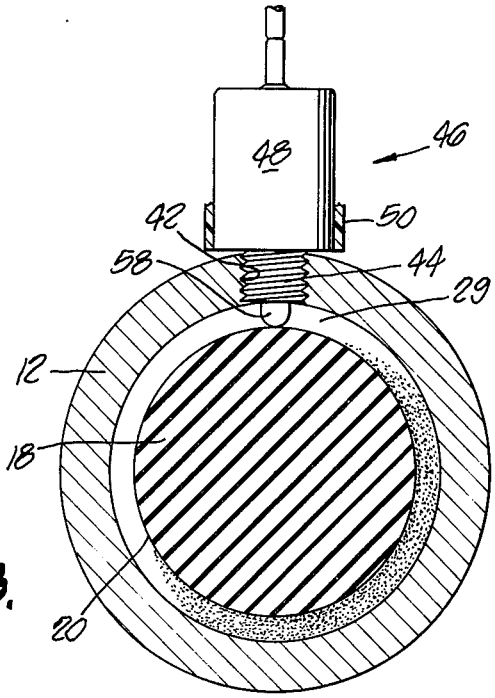
FIG. 3.

LOAD RESPONSIVE SWITCH ACTUATOR

BACKGROUND AND SUMMARY OF THE INVENTION

The present invention relates to load responsive switch actuator mechanisms.

There exists in numerous fields a need for a simple, reliable, inexpensive and effective mechanism for actuating a switch in response to a given condition, e.g., a compressive or tensile force above a predetermined level. The present invention provides such a mechanism.

The actuator mechanism of the present invention comprises a body of deformable material which, when subjected to compressive or tensile loads will actuate a switch and/or indicate the magnitude of the load to which the deformable body is subjected.

The details of the present invention and the many advantages to which the present invention gives rise will be appreciated from a review of the appended drawings and the following detailed description of two preferred embodiments. It is to be understood that the two embodiments shown in the drawings and described below are merely representative of two exemplary devices constructed in accordance with the teachings of the present invention. It is contemplated that numerous other embodiments constructed in accordance with the teachings of the present invention may be designed without departing from the spirit and scope of the present invention.

BRIEF DESCRIPTION OF THE DRAWINGS

In the drawings:

FIG. 1 is a front elevation view, partly in section, of one preferred embodiment of the load responsive switch actuator mechanism of the present invention for sensing compressive forces above a predetermined magnitude and actuating an associated switch in response thereto.

FIG. 2 is a partial front elevation view, partly in section, showing the interior of the FIG. 1 embodiment of the load responsive switch actuator mechanism of the present invention in the absence of a compressive load sufficient to actuate the associated switch.

FIG. 3 is an end elevation view, partly in section, taken along the plane 3—3 of FIG. 2 and looking in the direction of the arrows.

FIG. 4 is a partial front sectional elevation view of the embodiment of the load responsive switch actuator mechanism of the present invention shown in FIGS. 1–3, said view being similar to FIG. 2 but showing the mechanism of the present invention under a sufficient compressive load to actuate the associated switch.

Figure 5:
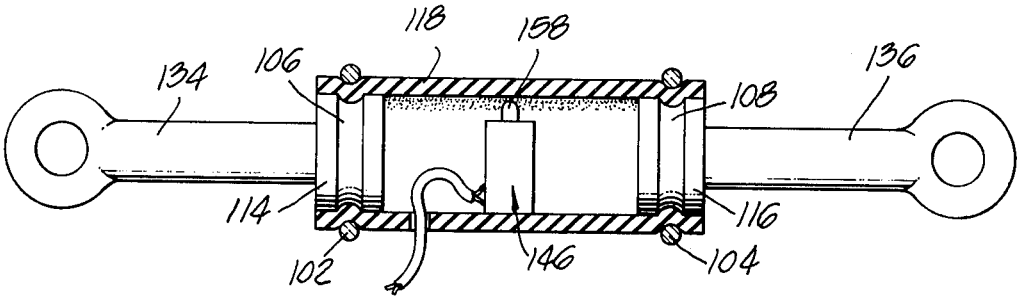
FIG. 5 is a front sectional elevation view of a second preferred embodiment of a load responsive switch actuator mechanism of the present invention for sensing tensile forces or loads above a predetermined magnitude and actuating an associated switch in response thereto.

Referring to the drawings, there is shown in FIGS. 1–4 one preferred embodiment of a load responsive switch actuator mechanism 10 constructed in accordance with the teachings of the present invention. The mechanism 10 is adapted to actuate a switch 46 in response to a compressive load above a predetermined level.

The load responsive switch actuator mechanism 10 comprises a generaly tubular cylindrical housing 12, a pair of pistons 14, 16 slidably mounted in the housing 12, and a generally cylindrical body of elastomeric material 18 disposed between the pistons 14 and 16.

The elastomeric member 18 may have its central portion 20 of reduced diameter. Annular grooves 22, 24 are provided within the tubular cylinder 12 adjacent either end thereof for receiving retaining rings 26, 28, respectively. The retaining rings 26 and 28 have an inner diameter which is somewhat smaller than the outer diameter of the pistons 14 and 16. Accordingly, the retaining rings 26 and 28 retain the pistons 14 and 16, respectively, within the piston chamber 29 defined by the interior peripheral wall of the tubular cylinder 12.

The pistons 14 and 16 are integrally connected at their outer ends to threaded connecting rods 30 and 32, respectively. The connecting rods 30 and 32 extend out of the cylindrical housing 12 and have links 34 and 36, respectively, connected thereon and retained by means of lock nuts 38 and 40, respectively.

As shown in FIGS. 1–4, the tubular cylinder 12 is provided with a threaded hole 42 therein for receiving the threaded stub 44 of a switch 46.

The detailed structure of the switch 46 is best shown in FIGS. 2 and 3. The switch 46 includes a housing 48 enclosed by an insulative cover 50. The threaded stub 44 which screws into the threaded hole 42 in the cylindrical housing 12 is integrally connected to the switch housing 48 at the lower end thereof.

Disposed within the switch housing 48 at the upper end thereof are top and bottom plates 52 and 54, respectively, which are spaced from one another by means of a cylindrical wall 56.

A plunger 58 made of a nonconductive material (e.g., plastic) extends downwardly through a central hole in the threaded stub 44 and into the chamber 29 when the switch 46 is in the nonactuated position shown in FIGS. 2 and 3.

The nonconductive plunger 58 has a generally radially outwardly extending shoulder 60 thereon. A compression spring 62 is disposed between the upper surface of the shoulder 60 and the bottom surface of the bottom plate 54. Thus, the compression spring 62 serves to normally maintain the plunger in its lowermost position shown in FIG. 2.

The plunger 58 has a reduced diameter upper end 64 which extends through a hole 66 in the bottom plate 54 and into the chamber 67 defined by the top and bottom plates 52, 54 and the cylindrical wall 56. A conductive washer or annulus 68 is positioned around the reduced-diameter portion 64 of the plunger 58 and is retained in place by means of the peened top end 70 of the plunger 58.

Extending through the top plate 52 of the switch assembly 46 are a pair of contacts 72, 74 which are connected to a pair of terminals 76, 78, respectively. The terminals 76 and 78 are connected to wires 80 and 82, respectively. The wires 80 ad 82 are covered by conventional nonconductive tubing 84 and 86, respectively. The outer ends of the wires 80 and 82 (not shown) may be connected to any suitable apparatus or indicating mechanism.

In operation, the compression spring 62 normally maintains the plunger 58 in its lowermost position shown in FIGS. 2 and 3, wherein the lower end of the plunger 58 extends partially into the piston chamber 29 defined by the interior peripheral wall of the cylinder housing 12.

When one or both of the links 34, 36 and the connecting rods 30, 32 and pistons 14, 16 to which they are connected are subjected to a compressive linear force (i.e., a force acting inwardly toward the cylindrical elastomeric member 18) the cylindrical elastomeric member 18 will be compressed, as shown in FIG. 4, causing the reduced-diameter central portion 20 thereof to move radially outwardly. As the central portion 20 of the elastomeric member 18 moves radially outwardly, it will force the bottom portion of the plunger 58 upwardly, as shown in FIG. 4, to move the integral shoulder 60 and the conductive washer or annulus 68 upwardly to the position shown in FIG. 4, overcoming the force of spring 62. In this position (FIG. 4) the conductive annulus contacts and electrically connects the contacts 72, 74 to one another, thereby completing the circuit (not shown) and signaling the apparatus or indicator (not shown) to which the ends of the wires 80 and 82 are connected.

When the compressive linear force is removed the elastomeric member 18 will expand to its normal position (FIG. 2), and the spring 62 will return the plunger 58 to its lowermost position (FIG. 2) wherein the lower portion of the plunger 58 extends into the piston chamber 29 and the conductive washer or annulus 68 is spaced from and out of contact with the contacts 72 and 74.

FIG. 5 shows a second embodiment of the load responsive switch actuator mechanism of the present invention, wherein the elastomeric member 118 is of tubular shape. A switch 146 (similar to the switch 46 in the embodiment of FIGS. 1–4) is disposed within the cylindrical chamber defined by the interior peripheral wall of the elastomeric tube 118. Suitable links 134 and 136 having heads 114 and 116, respectively, mounted thereon are attached to the ends of the tubular elastomeric member 118. The heads 114 and 116 are attached to the ends of the elastomeric tube 118 by means of lock rings 102 and 104, respectively, which force and retain annular portions of the elastomeric tube in annular grooves 106 and 108 in the heads 114 and 116, respectively.

Figure 6:
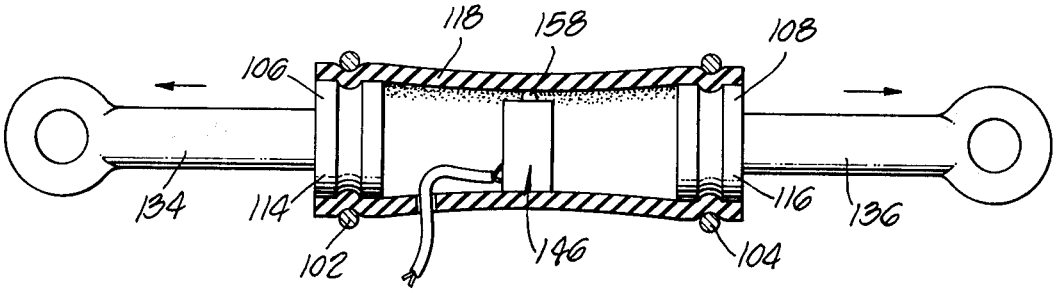
FIG. 6 is a front sectional elevation view of the load responsive switch actuator mechanism of the present invention shown in FIG. 5, said view being similar to FIG. 5 but showing the mechanism under a sufficient tensile load to actuate the associated switch.

When one or both of the links 134, 136 and the pistons 114, 116 to which the links are connected are subjected to a tensile force, the mean diameter of the tubular elastomeric member 118 will be reduced, as shown in FIG. 6, to move the plunger 158 of the switch 146 inwardly, thereby actuating the switch.

When the tensile force on links 134 and 136 is removed, the elastomeric tube 118 will return to its normal position (FIG. 5), and the spring (not shown but like the spring 62 in the embodiment of FIGS. 1–4) will return the plunger 158 to its normal position (FIG. 5) thereby returning the switch to its normal (open) condition.

The material of which the member 18 of the embodiment of FIGS. 1–4 and the member 118 of the embodiment of FIGS. 5–6 are made may be any suitable deformable material, such as a rubber or another elastomeric material. The specific characteristics, nature and consistency of the material will depend upon the environment in which the invention is used. The material of the member 18 (FIGS. 1–4) and the member 118 (FIGS. 5–6) should be such that the material will not significantly change its properties (e.g., consistency, size, etc.) in the environment in which the mechanism is used.

As indicated at the outset of this specification, there are a very large number of possible uses of the present invention other than the two specific embodiments shown in the drawings and described above. For example, a load responsive mechanism constructed in accordance with the teachings of the present invention may be used as a motion or impact sensor. When so used it may be mounted, for example, on the front end of an automobile for the purpose of actuating a switch to trigger any suitable mechanism (e.g., the inflation system of protective air bags) when the automobile decelerates too rapidly or is involved in a collision.

Another contemplated exemplary use of the present invention is as a load limiting mechanism in industrial machinery (e.g., punches, presses, automated assembly lines, etc.). When so used the switch actuator mechanism of the present invention may be designed to sense predetermined excessive pressures, above a predetermined level, to shut down the machinery through suitable logic circuitry.

It is to be understood that the possible uses of the mechanism of the present invention set forth above are set forth for exemplary purposes only. It is contemplated that numerous other uses of the present invention may be made. Further, it is contemplated that numerous modifications, additions and/or changes may be made to the examplary mechanisms shown in the drawings and described above, without departing from the spirit and scope of the present invention. Accordingly, it is intended that this patent be limited only by the scope of the appended claims.

I claim:

1. A switch and switch actuator assembly comprising:

a generally cylindrical housing member having a peripheral wall; means defining an opening in said peripheral wall of said housing;

said peripheral wall of said cylindrical housing having an interior peripheral surface defining a chamber;

a generally cylindrical body of deformable material disposed within said housing chamber; said cylindrical body of deformable material being co-axially aligned with said cylindrical housing; said cylindrical body having a central portion;

said interior peripheral surface of said peripheral wall of said cylindrical housing and the outer peripheral surface of said central portion of said deformable cylindrical body defining a generally annular space therebetween in said housing chamber;

a switch mechanism mounted in said opening in said peripheral wall of said housing; said switch mechanism including a switch actuator arm extending into said annular space and terminating in relatively close proximity to said central portion of said deformable cylindrical body;

a pair of piston members slidably and co-axially disposed within said chamber of said cylindrical housing;

each of said pistons having an inner end wall contacting one end of said deformable cylindrical body, whereby said cylindrical body may be compressed when said pistons move inwardly toward one another;

said central portion of said deformable body being enlarged in response to compression thereof by said pistons to move said switch actuating arm and operate said switching mechanism, and retaining means within said cylindrical body for retaining said pistons within said cylindrical housing.

2. A switch and switch actuator assembly comprising:

a generally cylindrical housing member having a peripheral wall; means defining an opening in said peripheral wall of said housing;

said peripheral wall of said cylindrical housing having an interior peripheral surface defining a chamber;

a generally cylindrical body of deformable material disposed within said housing chamber; said cylindrical body of deformable material being co-axially aligned with said cylindrical housing; said cylindrical body having a central portion;

said interior peripheral surface of said peripheral wall of said cylindrical housing and the outer peripheral surface of said central portion of said deformable cylindrical body defining a generally annular space therebetween in said housing chamber;

a switch mechanism mounted in said opening in said peripheral wall of said housing; said switch mechanism including a switch actuator arm extending into said annular space and terminating in relatively close proximity to said central portion of said deformable cylindrical body; and means co-axially disposed within said chamber of said cylindrical housing for compressing said cylindrical body in response to an externally applied compressive force, said central portion of said deformable body being enlarged in response to compression thereof to move said switch actuating arm and operate said switching mechanism.

3. A switch actuating mechanism comprising:

a generally cylindrical hollow body of deformable material having a central portion and first and second end portions, said central body portion being adapted to change in at least one dimension when said body is subjected to a tensile force;

switch means disposed within said body and adjacent said central portion, said switch means having at least first and second states; said switch means having a switch actuator element operatively associated with said central portion of said body for changing the state of said switch means from said first state to said second state when said body is subjected to a tensile force; and means operatively associated with said first and second portions to apply a tensile force to said body, the application of tensile force to said body causing said central portion thereof to contact said switch actuator element whereby said switch means changes from said first state to said second state.

4. The switch actuating mechanism as defined in claim 3, wherein removal of said tensile force removes said body central portion from contact with said switch actuator element whereby said switch means changes from said second state to said first state.

* * * * *